US005761586A

United States Patent [19]

Kawashima et al.

[11] Patent Number: 5,761,586

[45] Date of Patent: Jun. 2, 1998

[54] DEVELOPING DEVICE FOR IMAGE FORMING APPARATUS, TONER CONTAINER INSERTABLE INTO THE DEVELOPING DEVICE, AND IMAGE FORMING APPARATUS PROVIDED THEREWITH

[75] Inventors: Tetsuro Kawashima; Yasuyuki Hirai, both of Osaka, Japan

[73] Assignee: Mita Industrial Co., Ltd., Osaka-fu, Japan

[21] Appl. No.: 814,963

[22] Filed: Mar. 10, 1997

[30] Foreign Application Priority Data

Mar. 13, 1996 [JP] Japan ..... 8-056001

[51] Int. Cl.[6] ..... G03G 15/08

[52] U.S. Cl. ..... 399/262; 399/120; 222/DIG. 1

[58] Field of Search ..... 399/262, 263, 399/258, 259, 120; 222/DIG. 1

[56] References Cited

U.S. PATENT DOCUMENTS 4,740,808 4/1988 Kasamura et al. .
5,049,930 9/1991 Okano et al. .
5,055,881 10/1991 Fukuchi .
5,206,692 4/1993 Ishida et al. .
5,229,824 7/1993 Tsusaka et al. .
5,440,376 8/1995 Hagihara .
5,477,307 12/1995 Bergen et al. .
5,491,537 2/1996 Suzuki et al. .
5,528,349 6/1996 Satake ..... 222/DIG. 1
5,557,381 9/1996 Sakamoto et al. ..... 222/DIG. 1
5,621,507 4/1997 Nishimura et al. ..... 399/111
5,671,461 9/1997 Ishii ..... 399/27

FOREIGN PATENT DOCUMENTS 0570993 11/1993 European Pat. Off. .

*Primary Examiner*—R. L. Moses
*Attorney, Agent, or Firm*—Jordan and Hamburg

[57] ABSTRACT

A developing device includes a toner container for supplying toner; and a container receptacle for receiving the toner container therein. The container receptacle includes a positioning plate for positioning the toner container with respect thereto by making contact with a frontal end of the toner container in an insertion direction, and engaging means provided on the positioning plate. The engaging means has a first engaging member, and a second engaging member partially surrounding the contour of the first engaging member when viewed from a rear end of the toner container in the insertion direction.

15 Claims, 12 Drawing Sheets

DEVELOPING DEVICE FOR IMAGE FORMING APPARATUS, TONER CONTAINER INSERTABLE INTO THE DEVELOPING DEVICE, AND IMAGE FORMING APPARATUS PROVIDED THEREWITH

BACKGROUND OF THE INVENTION AND RELATED ART STATEMENT

The present invention relates to a developing device used for an electrophotographic image forming apparatus, a toner container insertable into this developing device and an image forming apparatus provided therewith.

Generally, in an electrophotographic image forming apparatus, after an electrostatic latent image formed on a photosensitive member is developed by attaching toner supplied from a developing device thereto, this toner image is transferred to and fixed on a copy sheet. Since toner is consumed as images are formed, the existing developing device is provided with a hopper so as to ensure a supply of toner from the developing device to the photosensitive member and a toner container for containing toner is exchangeably insertable into the toner container. If the toner in a toner container to be newly inserted is of different kind from the toner specified for the use with the developing device, there is a likelihood that image quality is degraded by, e.g. forming abnormal images and that an imaging assembly is damaged. Accordingly, a structural design has been proposed which permits the insertion of a toner container containing the same kind of toner into the hopper (Japanese Unexamined Utility Model Publication No. 61-19255). According to this publication, the toner container is formed with an identifying engaging portion which differs depending upon the kind of the toner contained in the toner container, whereas the hopper is formed with a detecting portion in the form of a projection corresponding to the identifying engaging portion. Only when the positions of the identifying engaging portion and the detecting portion agree, the toner container is insertable into the hopper. More specifically, the identifying engaging portion is constructed by a groove (recess) projecting from a side surface of the toner container and extending in a sliding direction with respect to a specified position. On the other hand, the detecting portion is constructed by a projection formed in a position engageable with this recess. When the positions of the identifying engaging portion and of the detecting portion agree, the toner container is slidably insertable into the hopper without interference.

As disclosed in the above publication, since the detecting portion provided at the developing device is merely a projection, it is relatively likely to be damaged or broken. As a result, the insertion of a toner container having a different identifying engaging portion or containing a different kind of toner may be allowed, or a toner container having a similar outer shape, but no identifying engaging portion may freely be used. This presents a problem that a stable image quality cannot be ensured.

SUMMARY OF THE INVENTION

In view of the problems residing in the prior art, an object of the present invention is to provide a toner container which can be insertably set in a container receptacle of a developing device of a corresponding kind.

It is another object of the present invention to provide a developing device which is provided with an engaging projection so that only a compatible toner container can be insertably set and can prevent the engaging projection from being damaged or broken.

It is still another object of the present invention to provide an image forming apparatus provided with the above developing device and toner container.

The invention is directed to a developing device which comprises:

- a toner container for supplying toner;
- a container receptacle for receiving the toner container therein, the container receptacle includes
  - a positioning plate for positioning the toner container with respect thereto by making contact with a frontal end of the toner container in an insertion direction,
  - engaging means provided on the positioning plate, having a first engaging member, and a second engaging member partially surrounding the contour of the first engaging member when viewed from a rear end of the toner container.

With this construction, only the toner container having its front end with respect to the insertion direction which is engageable with both the first engaging member and the second engaging member can be insertably set. Accordingly, an erroneous mounting of a toner container having an incompatible specification can be prevented. Further, the second engaging member can prevent the first engaging member from being damaged or broken.

Preferably, the first engaging member may be in the form of a plurality of projections provided at a plurality of respective predetermined positions on the positioning plate.

With this arrangement, by changing the position where the projection is provided so as to conform to the kind of the developing device, it can be made impossible to set a incompatible toner container in the developing device.

The positioning plate may be of a polygonal shape and stands on the container receptacle, and the second engaging member of the protection wall portion includes a first protection wall standing along one side of the positioning plate and a second protection wall standing on another side thereof adjacent to the one side so as to meet each other.

With this arrangement, the projection can securely be enclosed by the first and second protection walls, thereby preventing the projection from being damaged or broken.

There may be provided an engaging portion formed at a front end of the toner container with respect to an insertion direction such that the engaging portion includes a first recess engageable with a projection formed in a specified position of a positioning plate of the container receptacle with which the front end of the toner container with respect to the insertion direction comes into contact, and a second recess engageable with a protection wall portion standing in such a position of the positioning plate as to enclose the projection.

With this arrangement, the toner container can be set in the developing device only in the case that the first recess is opposed to the projection projecting from the positioning plate of the container receptacle of the developing device with which the front end of the toner container with respect to the insertion direction comes into contact and the second recess is opposed to the protection wall portion standing on the positioning plate when the toner container is inserted into the developing device.

Further, the first recess can be continuously formed with the second recess.

With this arrangement, the engaging portion of the toner container can easily be formed.

The projections may be arranged in a line parallel to the first protection wall. The projections may be in the form of screw bolts and a plurality of threaded holes, with which the screw is engageable, can be formed on the positioning plate of the container receptacle. The number of the threaded holes on the positioning wall of the container receptacle can be set more than the number of screw bolts used as the first engaging member of the container receptacle.

With the above structure, the several choices of the first engaging member is made available by changing the selection of the threaded holes with which engaging members engage. Thus it may be easily meet the required changes in a configuration of the corresponding engaging portion at the leading end of the toner container. For instance, when some model change takes place, it would be advantageous to change the pitch of the recesses (as engageable member of the toner container) according to the corresponding positions of the screw bolts projecting from the positioning wall of the container receptacle.

The second engaging member, a plate like projection extending from the positioning plate of the toner receptacle may be in L-shape viewed from a rear end of the toner container in the container insertion direction.

With this structure, the first engaging member in the form of projection can be more reliably protected from being damaged by the L-shaped engaging member.

This invention is also directed to a toner container adapted to be set in a container receptacle of a developing device to supply toner to the developing device, the toner container comprises an engaging portion formed at a front end thereof with respect to an insertion direction, the engaging portion includes a first engaging member engageable with a projection formed in a specified position of a positioning plate of the container receptacle with which the front end of the toner container with respect to the insertion direction comes into contact, and a second engaging member engageable with a protection wall portion standing in a position of the positioning plate as to enclose the projection.

This invention is also directed to an electrophotographic image forming apparatus for transferring a toner image obtained by developing an electrostatic latent image formed on the surface of a photosensitive member with toner to a copy sheet, the electrophotographic image forming apparatus comprises:

a developing device includes
- a toner container for supplying toner and
- a container receptacle for receiving the toner container therein,
  - the container receptacle having a receptacle engaging portion projecting from a positioning plate for positioning the toner container by being brought into contact with a front end of the toner container to be set with respect to an insertion direction,
    - the receptacle engaging portion having a projection formed in a specified position of the positioning plate and a plate-like protection wall portion standing in a position on the positioning plate as to enclose the projection, and
  - the toner container includes a container engaging portion formed at the front end thereof with respect to the insertion direction,
    - the container engaging portion having a first recess engageable with the projection and a second recess engageable with the protection wall portion.

With this construction, the toner container can be insertably set in the container receptacle of the developing device only when the device engaging portion projecting from the positioning plate of the container receptacle of the developing device and the container engaging portion formed at the front end of the toner container with respect to the insertion direction are engaged with each other. Accordingly, an erroneous mounting of a toner container of incompatible specification into the developing device can be prevented. Therefore, images of high quality can securely be formed using toner of compatible specification.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
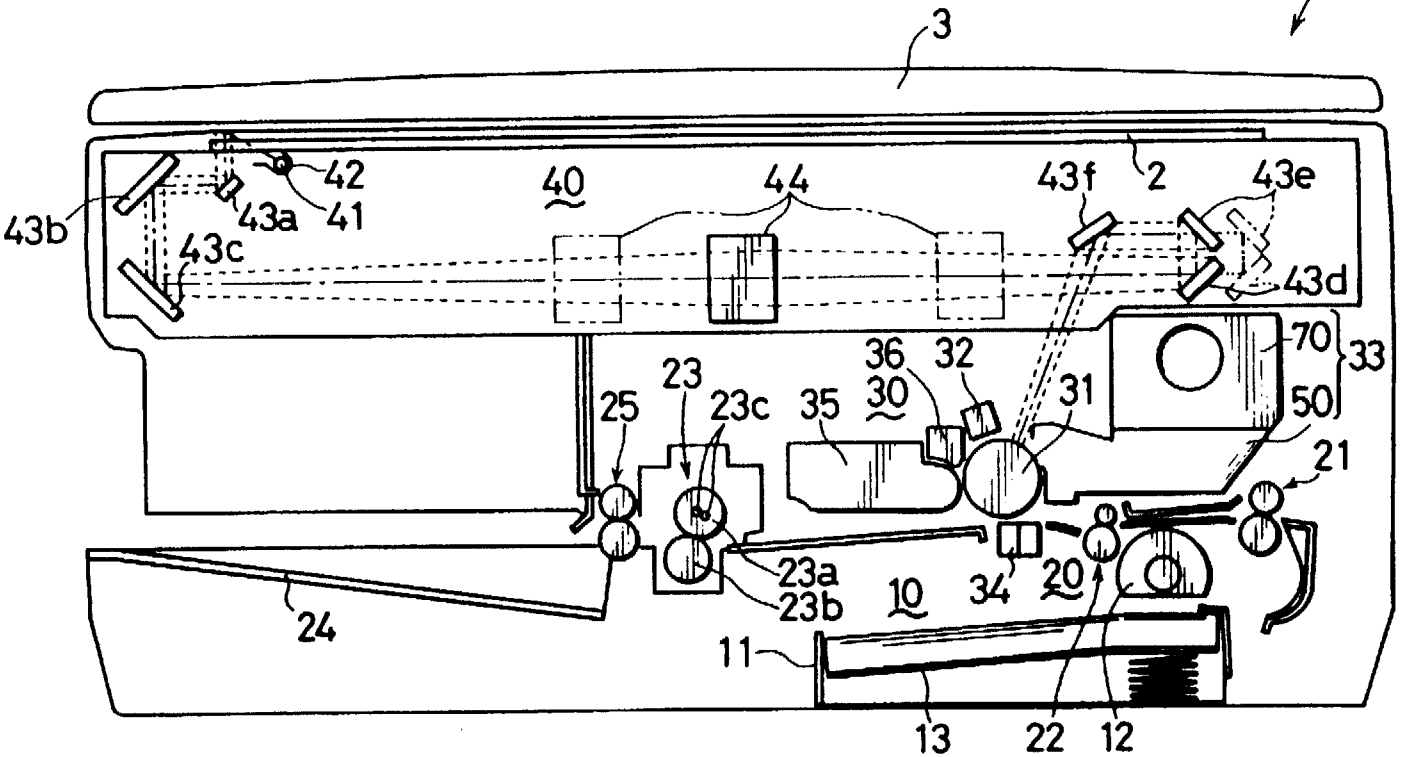
FIG. 1 is a front view showing the internal construction of an image forming apparatus according to one embodiment of the invention.

FIG. 1 is a front view showing the internal construction of an image forming apparatus according to one embodiment of the invention.

A main body 1 of this image forming apparatus is provided with a sheet feeding assembly 10 disposed at its bottom portion, a sheet transport assembly 20 disposed above the sheet feeding assembly 10, an imaging assembly 30 disposed above the sheet transport assembly 20, an optical assembly 40 disposed above the imaging assembly 30, a glass platen 2 disposed in the middle of its upper surface, and an original holder 3 for pressingly holding an original on the glass platen 2.

The sheet feeding assembly 10 includes a cassette 11 for containing copy sheets and a feed roller 12 disposed above a right end portion of the cassette 11. The cassette 11 has an upwardly biased sheet placing plate 13, and copy sheets are stacked on this sheet placing plate 13. The feed roller 2 has a substantially semicircular cross section and is disposed such that its flat surface is faced downward in its stop position so as not to hinder the attachment and detachment of the cassette 11.

The optical assembly 40 includes an exposure lamp 41, a reflector 42, reflection mirrors 43*a*, 43*b*, 43*c*, 43*d*, 43*e*, 43*f*, a lens 44 and an unillustrated moving means. This moving means reciprocates the exposure lamp 41, the reflector 42 and the reflection mirror 43*a* at a specified speed V, and the reflection mirrors 43*b*, 43*c* at a speed V/2 in the transverse direction of FIG. 1. During the forward movement of the above elements, an image of an original is scanned to form a corresponding electrostatic latent image on a photosensitive member 31 to be described later. Further, the lens 44 and the reflection mirrors 43*d*, 43*e* are movable along the transverse direction according to a copying magnification.

The imaging assembly 30 includes the rotatably supported photosensitive member or photosensitive drum 31, a main charger 32, a developing unit 33, a transfer/separating device 34, a cleaning device 35 and a charge removing device 36 arranged around the photosensitive drum 31 in this order from an upstream side with respect to a rotating direction. The main charger 32 uniformly charges the surface of the photosensitive drum 31 at a specified potential. An exposure area for a light image of the original is defined immediately downstream from the main charger 32. By this light image, an electrostatic latent image is formed on the surface of the photosensitive drum 31.

The developing unit 33 develops the electrostatic latent image by attaching toner thereto, and its construction is described later. The transfer/separating device 34 transfers the toner image on the surface of the photosensitive drum 31 to a copy sheet and separates the copy sheet from the photosensitive drum 31 after the image transfer. The cleaning device 35 cleans the toner residual on the surface of the photosensitive drum 31 after the image transfer. The charge removing device 36 removes residual charges on the surface of the photosensitive drum 31.

The sheet transport assembly 20 includes, from an upstream side with respect to a transport direction of sheet, a pair of transport rollers 21 for transporting a copy sheet fed from the sheet feeding assembly 10 to the photosensitive drum 31, a pair of registration rollers 21 driven in synchronism with a scanning timing of the optical assembly 40, a fixing device 23 for transporting the copy sheet separated from the photosensitive drum 31 while fixing the transferred toner image onto the copy sheet, and a pair of discharge rollers 25 for discharging the copy sheet onto a discharge tray 24.

The fixing device 23 includes a heating roller 23*a* and a pressure roller 23*b*. The heating roller 23*a* has a built-in heater 23*c* so as to keep the fixing device 23 at a specified fixing temperature where the transferred toner image can suitably be fixed onto the copy sheet. The pressure roller 23*b* is made of a material slightly softer than the surface of the heating roller 23*a* and is pressed against the heating roller 23*a* at a specified pressure.

The operation of the image forming apparatus constructed as above is described.

When a copy start key is pressed after a copy magnification and the number of copies to be made are set, a copying operation is started. More specifically, light from the exposure lamp 41 is reflected by an original placed on the glass platen 2, and this reflected light exposes the photosensitive drum 31 via the reflection mirrors 43*d* to 43*f* after being introduced to the lens 44 via the reflection mirrors 43*a* to 43*c*. At this stage, the surface of the photosensitive drum 31 has already uniformly be charged by the main charger 32, and an electrostatic latent image is formed by exposing the exposure area of the photosensitive drum 31 by the optical assembly 40. Subsequently, the electrostatic latent image is developed by attaching the charged toner supplied from the developing unit 33 to the photosensitive drum 31.

On the other hand, when being driven, the curved surface of the feed roller 12 comes into contact with the uppermost one of the copy sheets stacked on the sheet placing plate 13, thereby feeding the same. The fed sheet is transported to the registration roller pair 22 by the transport roller pair 21. Subsequently, the copy sheet is transported by the registration roller pair 22 in synchronism with the operation of the optical assembly 40 to a clearance between the photosensitive drum 31 and the transfer/separating device 34.

The toner image on the photosensitive drum 31 is transferred by the transfer/separating device 34 to the copy sheet, which is then transported to the fixing device 23 after being separated from the photosensitive drum 31. In the fixing device 23, the copy sheet is transported while being held between the rotating heating roller 23*a* and pressure roller 23*b*, and the toner image transferred to the copy sheet is fusibly fixed onto the copy sheet by the heat from the heating roller 23*a* and the pressure from the pressure roller 23*b*. Thereafter, the copy sheet is discharged onto the discharge tray 24 by the discharge roller pair 25.

Figure 2:
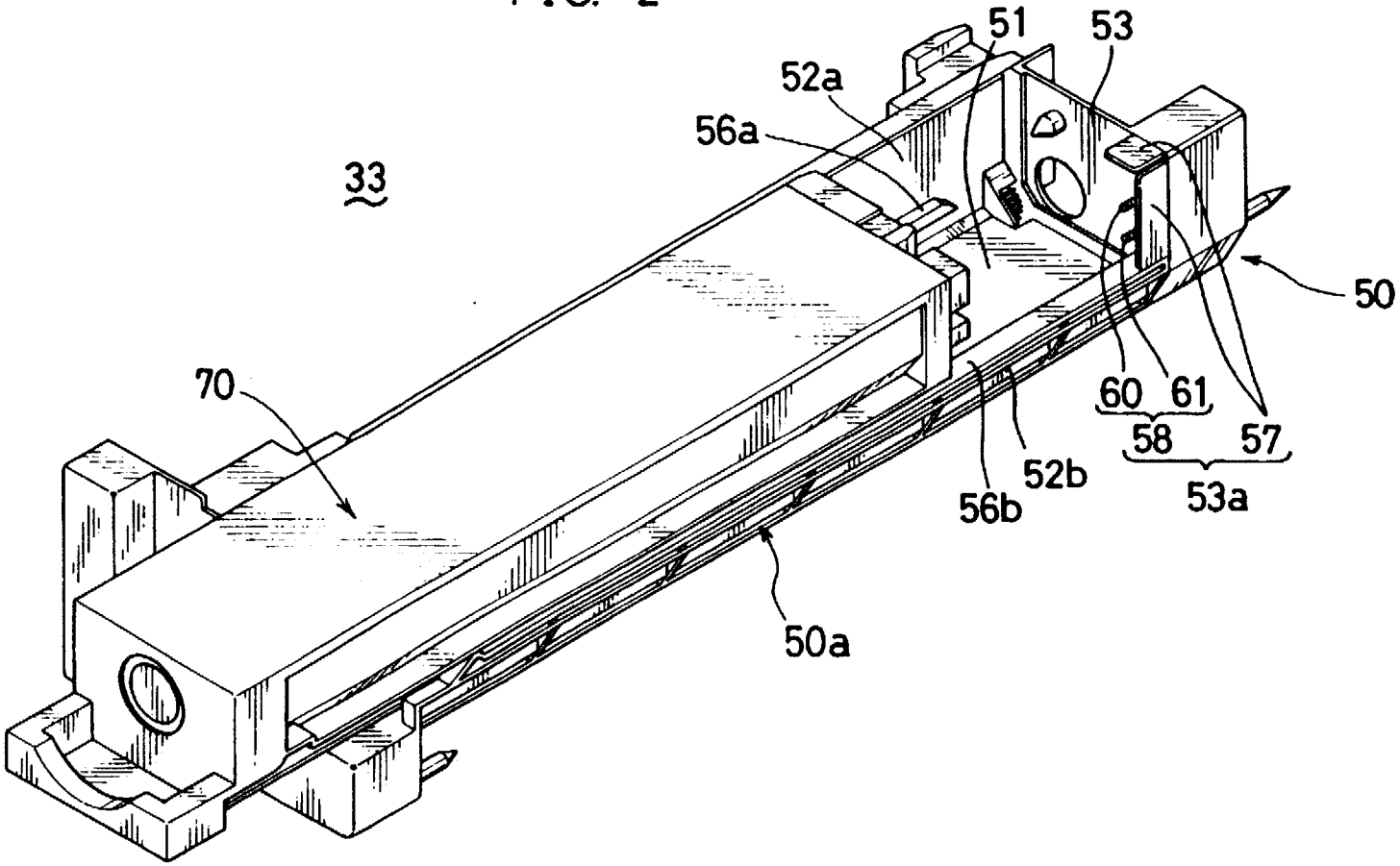
FIG. 2 is a perspective view of a developing unit according to the embodiment when a toner container is being inserted into a developing device.
Figure 3:
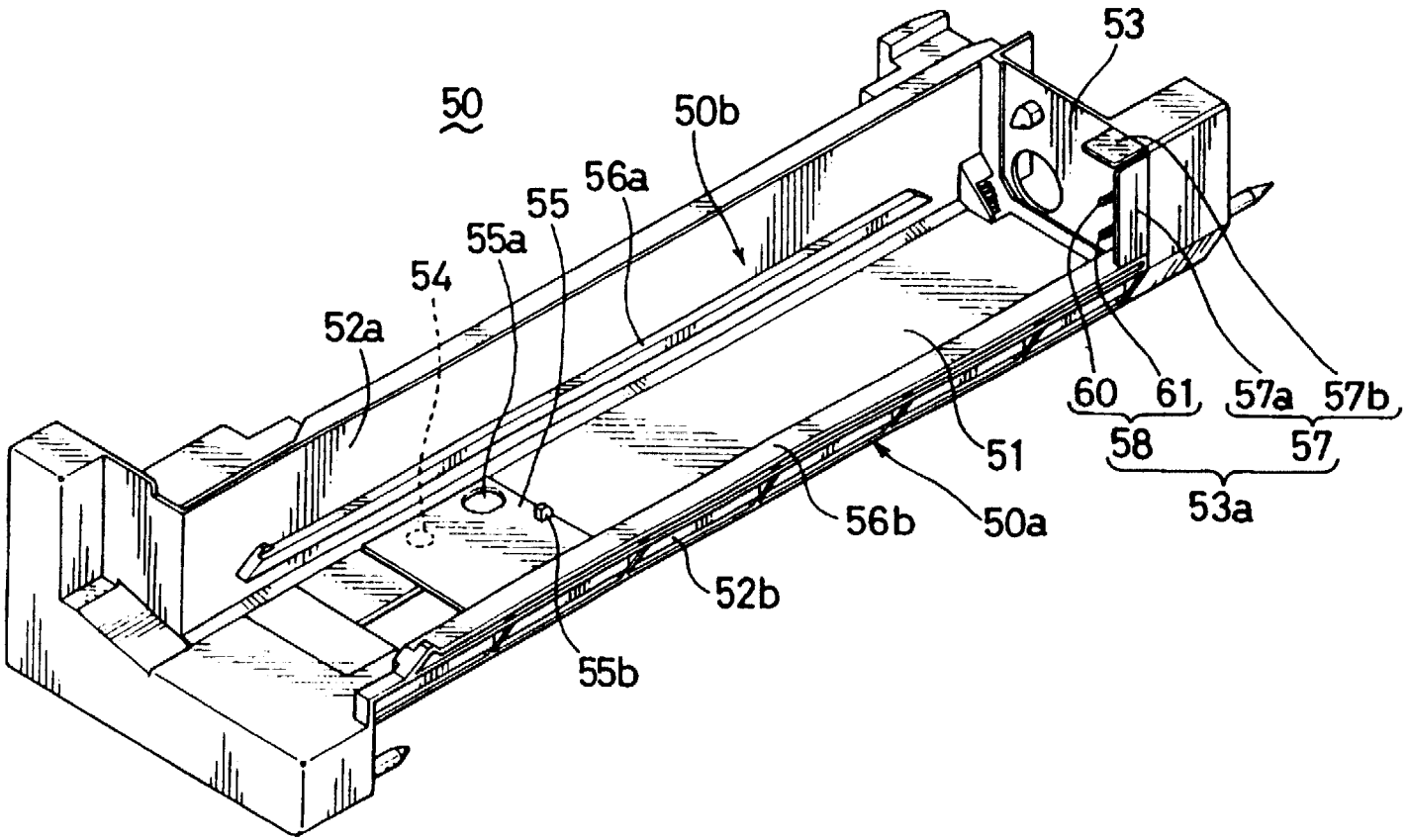
FIG. 3 is a perspective view of the developing device.
Figure 4A:
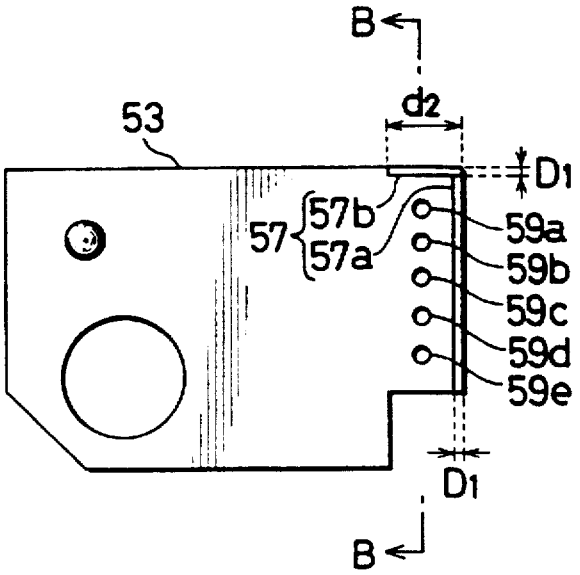
FIG. 4A is a front view of a side plate portion.
Figure 4B:
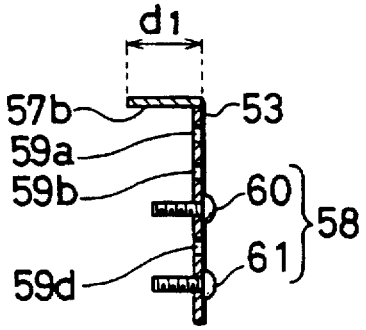
FIG. 4B is a section along B—B of FIG. 4A.

Next, the construction of the developing unit 33 is described with reference to FIGS. 2, 3, 4A and 4B. FIG. 2 is a perspective view of the developing unit 33 when a toner container 70 is being inserted into a developing device 50. FIG. 3 is a perspective view of the developing device 50; FIG. 4A is a front view of a side plate portion 53; and FIG. 4B is a section along B—B of FIG. 4A.

The developing unit 33 includes the developing device 50 provided at the apparatus main body and the toner container 70 insertable into the developing device 50 from front. Toner can continue to be supplied by replacing an old toner container 70 by a new one when the old toner container 70 becomes empty.

The developing device 50 includes a device main body 50*a* and a container receptacle 50*b* formed on the device main body 50*a* as shown in FIG. 3. The container receptacle 50*b* includes a bottom plate portion 51 having a substantially rectangular upper surface, side plate portions 52*a*, 52*b* standing at the left and right sides of the bottom plate portion 51 and extending along forward and backward directions, and a substantially rectangular side plate portion 53 standing at the back end of the bottom plate portion 51. The side plate portions 52*a*, 52*b* have the same height. The container receptacle 50*b* is in the shape of a box having an open upper surface.

The bottom plate portion 51 has a length slightly longer than an axial dimension of the photosensitive drum 31, and supplies charged toner to the surface of the photosensitive drum 31 through an unillustrated opening. The bottom plate portion 51 includes a toner supply port 54 for loading toner in the toner container 70 inside and a shutter member 55 for opening and closing the toner supply port 54. The shutter member 55 includes a round hole 55*a* formed before the toner supply port 54 and an engaging projection 55*b* formed in the middle of its front end, and is biased toward the front end (upper right direction in FIG. 3) by an unillustrated biasing member such as a spring.

The side plate portion 52*b* includes a guide rail 56*b* formed at its upper end, whereas the side plate portion 52*a* includes a guide rail 56*a* at the same height as the inner guide rail 56*b*.

The side plate portion 53 functions as a positioning plate with which the toner container 70 being inserted comes into contact to be positioned, and has an engaging portion 53*a* including a protection wall portion 57 and an engaging projection 58 projecting inwardly (toward the bottom plate portion 51), respectively.

The protection wall portion 57 (as a second engaging member) includes a first protection wall 57*a* standing at the right side of the side plate portion 53 and a second protection wall 57*b* standing at the upper side of the side plate portion 53 as shown in FIG. 3, and is substantially L-shaped when viewed from front as shown in FIG. 4A.

The first and second protection walls 57*a*, 57*b* (or a second engaging member) are made of a metal sheet of thickness $D_1$ as shown in FIG. 4A, and project from the side plate portion 53 by distance $d_1$ as shown in FIG. 4B. The first protection wall 57*a* extends substantially along the entire length of the right side of the side plate portion 53, whereas the second protection wall 57*b* has a width $d_2$ and abuts against the first protection wall 57*a* as shown in FIG. 4A. The outer surfaces of the respective protection walls 57*a*, 57*b* are in flush with the right and upper sides of the side plate portion 53.

The engaging projection 58 (as a first engaging member) is constructed by screws inwardly projecting while being spirally engaged with threaded holes formed in the side plate portion 53, and represents the specification of the developing device 50 such as the kind of toner to be used. The side plate portion 53 is formed with threaded holes 59*a* to 59*e* aligned along a vertical line within an area enclosed by the protection wall portion 57 as shown in FIG. 4A. More specifically, the word "enclosed" used here is to mean that the engaging projections are to be enclosed in an area of an imaginary rectangle whose short side and long side are formed by two protection walls 57*b*, 57*a*. In this embodiment, screws 60, 61 are spirally engaged with the threaded holes 59*c*, 59*e*.

Next, the construction of the toner container 70 is described with reference to FIGS. 5 and 6 which are perspective views of the toner container when viewed from above and from below, respectively.

Figure 5:
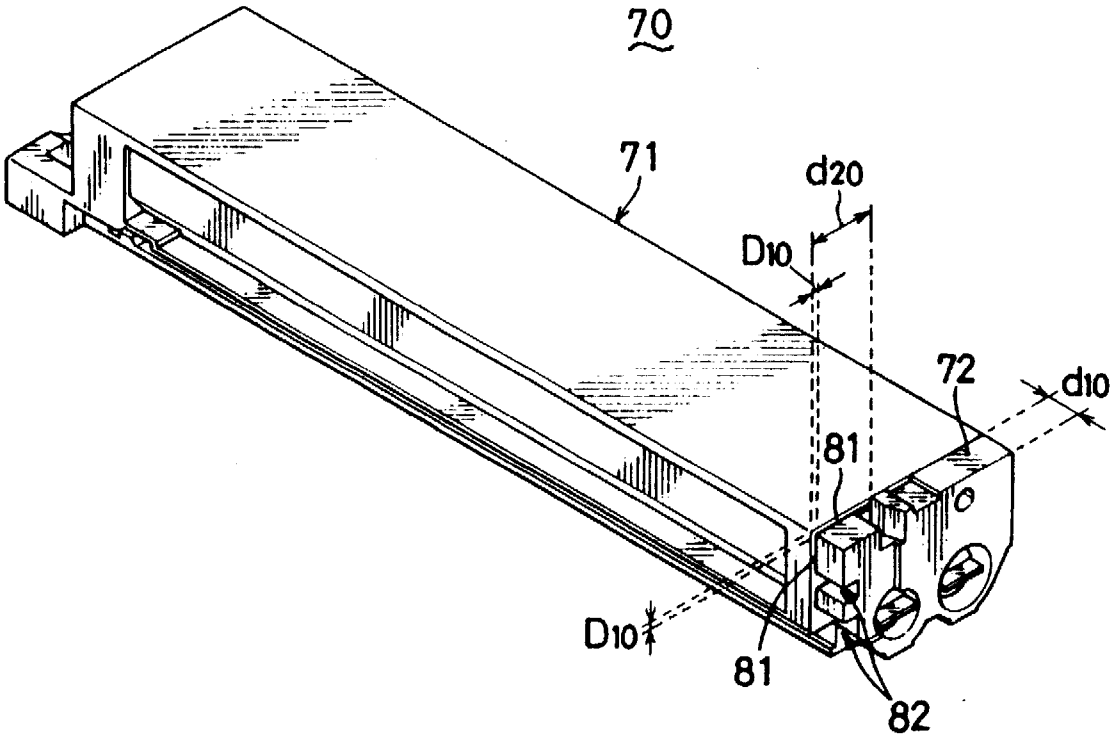
FIG. 5 is a perspective view of the toner container when viewed from above.

The toner container 70 has a substantially rectangular parallelepipedic shape as shown in FIG. 5, and includes a container main body 71 and an engaging portion 72 formed at the leading end of the container main body 71 with respect to an insertion direction (bottom right side in FIG. 5). The toner container 70 contains toner therein.

Figure 6:
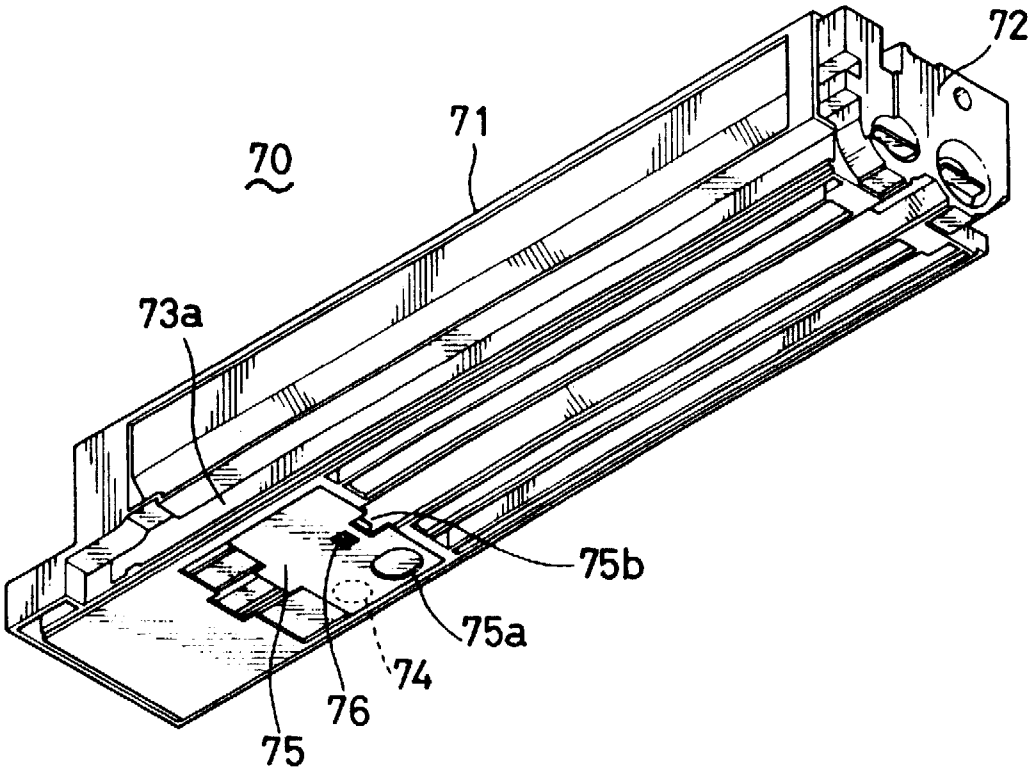
FIG. 6 is a perspective view of the toner container when viewed from below.

The container main body 71 is, as shown in FIG. 6, provided with grooves 73*a*, 73*b* (not shown) extending along the bottom of the opposite long side surfaces. The toner container 70 can be assembled with the developing device 50 as shown in FIG. 2 by fitting the grooves 73*a*, 73*b* to the corresponding guide rails 73*a*, 73*b* and inserting the toner container 70 in this state.

The container main body 71 includes a toner discharge port 74 formed in a position to be opposed to the toner supply port 54 of the developing device 50 when the toner container 70 is insertably set in the developing device 50, and a shutter member 75 for opening and closing the toner discharge port 74. The shutter member 75 is formed with a round hole 75*a* before the toner discharge port 74 in its usual position, and an engaging wall 75*b* standing upright in a middle position of its front end. The shutter member 75 is biased toward the front (upper right direction in FIG. 6) by a biasing member 76 such as a spring.

As shown in FIG. 5, the engaging portion 72 has a length $d_{10}$ and includes first recesses 82 (as a first engageable member) formed in positions to be opposed to the engaging projection 58 (see FIG. 3) and second recesses 81 (as a second engageable member) formed in positions to be opposed to the protection wall portion 57 (see FIG. 3). It should be noted that $d_1 \approx d_{10}$.

Figure 7:
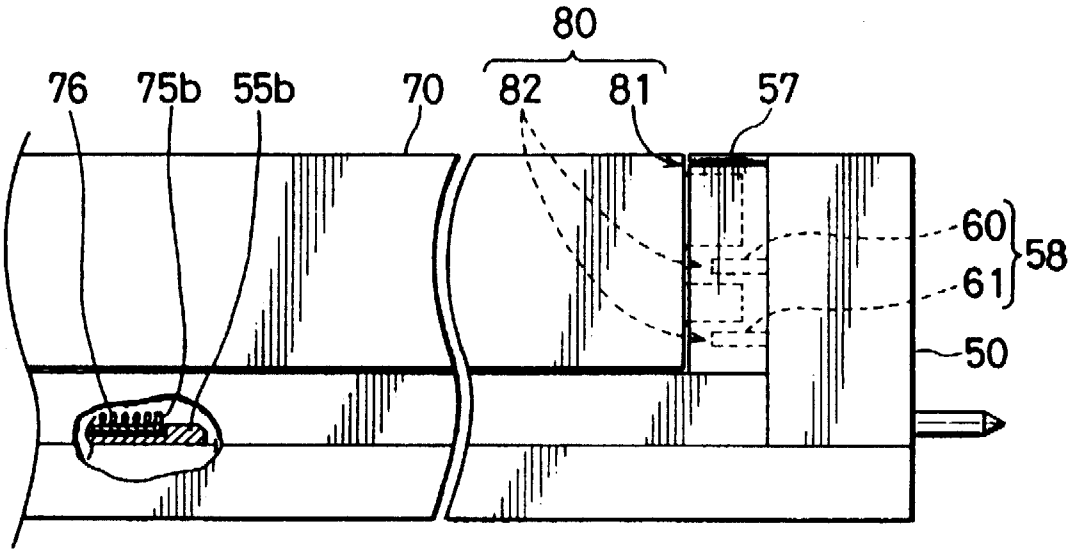
FIG. 7 is a side view showing a state where the toner container is set in the developing device.

The second recesses 81 are narrow recesses extending along the left and upper edge of the engaging portion 72 in FIG. 7. The second recess 81 extending along the upper edge has a width $D_{10}$ and a length $d_{20}$ (where $D_{10} \geqq D_1$, $d_{20} \geqq d_2$). Accordingly, the engaging portion 72 is narrowed by the width $D_{10}$ where the second recess 81 is formed.

The first recesses 82 are formed at the height facing the screws 60, 61 of the engaging projection 58 so that the screws 60, 61 are allowed to inwardly project a specified distance without being interfered by the engaging portion 72.

Next, how the toner container 70 is insertably set in the developing device 50 is described with reference to FIGS. 2, 3, 6, 7 and 8.

Figure 8:
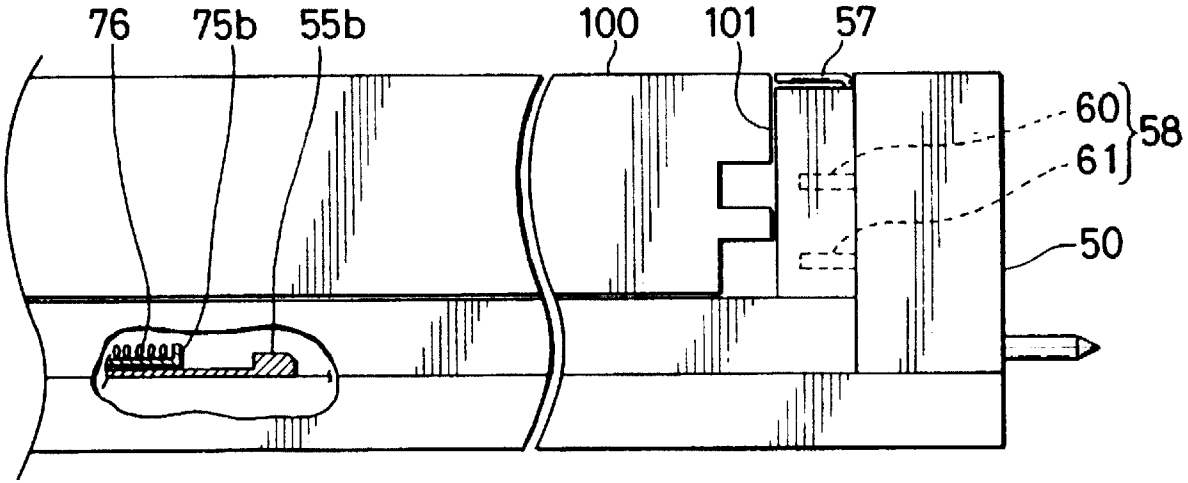
FIG. 8 is a side view showing a state where a toner container not formed with a projection wall portion is inserted into the developing device.

FIG. 7 is a side view showing a state where the toner container 70 is set in the developing device 50, and FIG. 8 is a side view showing a state where a toner container 100 not formed with the second recesses 81 is inserted into the developing device 50.

When the toner container 70 is inserted into the developing device 50 as shown in FIG. 2, the protection wall portion 57 of the developing device 50 and the second recesses 81 of the toner container 70 are engaged, and the engaging projection 58 of the developing device 50 and the first recesses 82 of the toner container 70 are engaged, properly setting the toner container 70 in the developing device 50. At this stage, the engaging projection 55*b* of the shutter member 55 of the developing device 50 shown in FIG. 3 and the engaging wall 75*b* of the shutter 75 of the toner container 70 shown in FIG. 6 are engaged with each other as shown in FIG. 7.

On the other hand, the apparatus main body is provided with a shutter opening member (not shown) for opening and closing the shutter member 55 of the developing device 50 shown in FIG. 3. When the developing device 50 assembled with the toner container 70 is mounted on the apparatus main body from the front side (front side in FIG. 7) to the back side, the shutter member 55 of the developing device 50 is moved toward the lower left side of FIG. 3 (left side of FIG. 7) against the biasing force of the biasing member by the shutter opening member as the developing device 50 moves in its mounting direction, with the result that the round hole 55*a* is brought to a position where it is in agreement with the toner supply port 54 to release the same.

Further, since the engaging projection 55*b* is engaged with the engaging wall 75*b* as shown in FIG. 7, the shutter member 75 of the toner container 70 is also moved to the lower left side of FIG. 6 (front side of FIG. 7) against the biasing force of the biasing member 76 as the shutter member 55 of the developing device 50 shown in FIG. 3 moves, with the result that the round hole 75*a* is brought to a position where it is in agreement with the toner discharge port 74 to release the same. This enables the supply of toner from the toner discharge port 74 to the toner supply port 54.

If the toner container 100 not formed with the second recesses 81 is inserted into the developing device 50 as shown in FIG. 8, the protection wall portion 57 of the developing device 50 comes into contact with a front end surface 101 of the toner container 70, making it impossible to set the toner container 100 in the developing device 50.

Since the developing device 50 is provided with the protection wall portion 57 projecting from the side plate portion 53, toner containers not formed with the second recesses 81 cannot be set in the developing device 50. This can prevent an erroneous mounting of a toner container containing toner of a kind not suited to the specification of the developing device 50.

Further, since the developing device 50 is provided with the engaging projection 58 projecting from the side plate portion 53, toner containers not having the first recesses 82 in the corresponding positions cannot be set in the developing device 50. This can also prevent an erroneous mounting of a toner container containing toner of a kind not suited to the specification of the developing device 50.

Furthermore, since the engaging projection 58 is constructed by the screws 60, 61 spirally engaged with two of the threaded holes 59*a* to 59*e*, the engaging projection 58 can cope with 10 different specifications by changing the combination of the threaded holes to be engaged with the screws 60, 61 according to the specification of the developing device 50.

By forming the first protection wall 57*a* to stand along the entire length of the right side of the side plate portion 53 and disposing the second protection wall 57*b* so as to abut against the first protection wall 57*a*, the protection wall portion 57 can enclose the engaging projection 58. Thus, the damage of the engaging projection 58 can be prevented. Note that it is a matter of design choice to increase the thickness of the protection walls 57*a*, 57*b* to reinforce its resistance against the force applied from outside thereby functioning as a more reliable protection for the projections. Therefore the thickness of the protection wall is to be adequately chosen.

Further, since the toner container 70 is provided with the second recesses 81 formed at the engaging portion 72, it can be insertably set not only in a new type of developing device 50 provided with the protection wall portion 57, but also in old type of developing unit not provided with the protection wall portion 58 if the developing unit has a corresponding engaging projection 58. Thus, the toner container 70 is allowed to have a satisfactory interchangeability.

Furthermore, since the toner container 70 is provided with the first recesses 82 formed at the engaging portion 72, it can only be set in the developing device 50 provided with a corresponding engaging projection 58. This can prevent the toner container 70 from being erroneously mounted on a developing device 50 having a specification incompatible with the toner contained therein.

The present invention is not limited to the foregoing embodiment, it may be embodied as in the following modifications (1) to (3).

Figure 9:
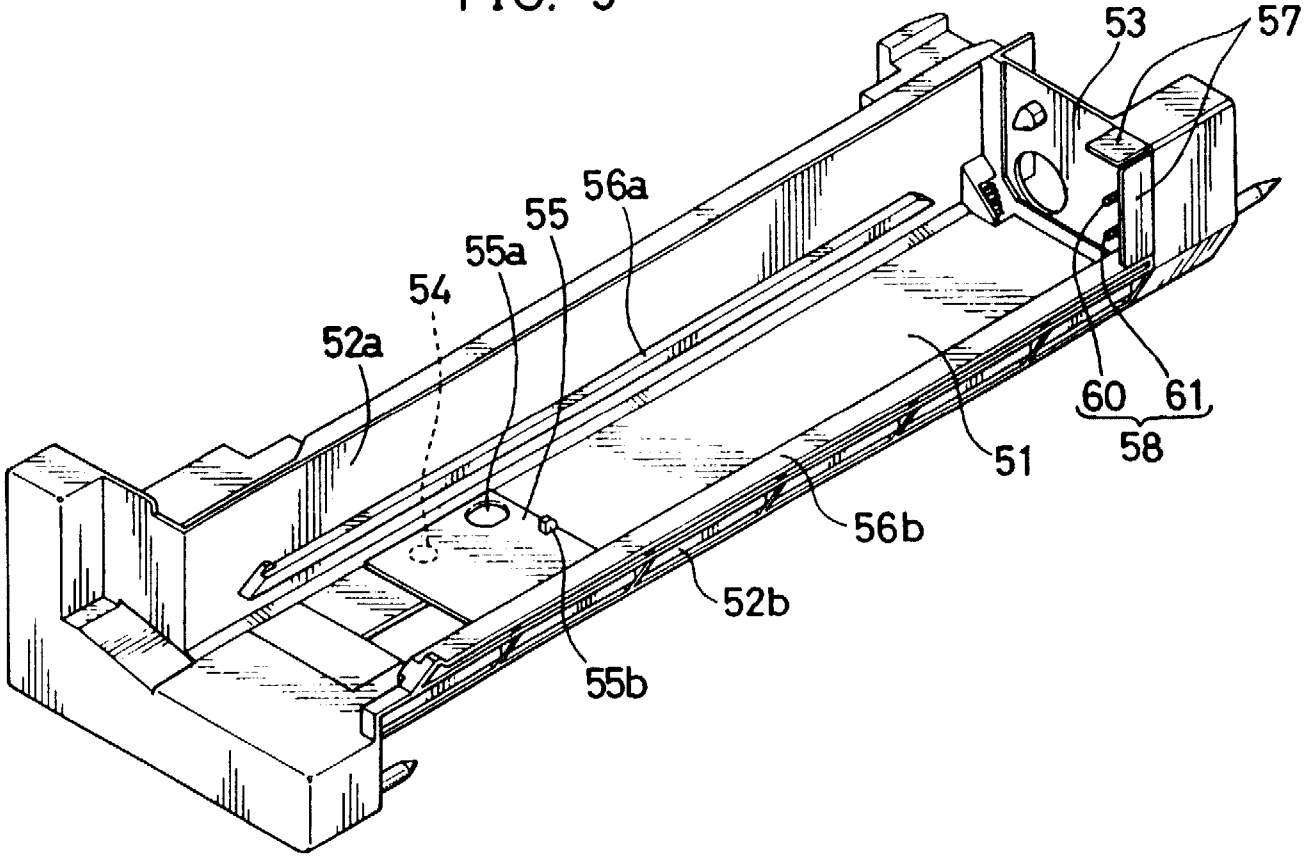
FIG. 9 is a perspective view of a developing device according to a modification (1)
Figure 10:
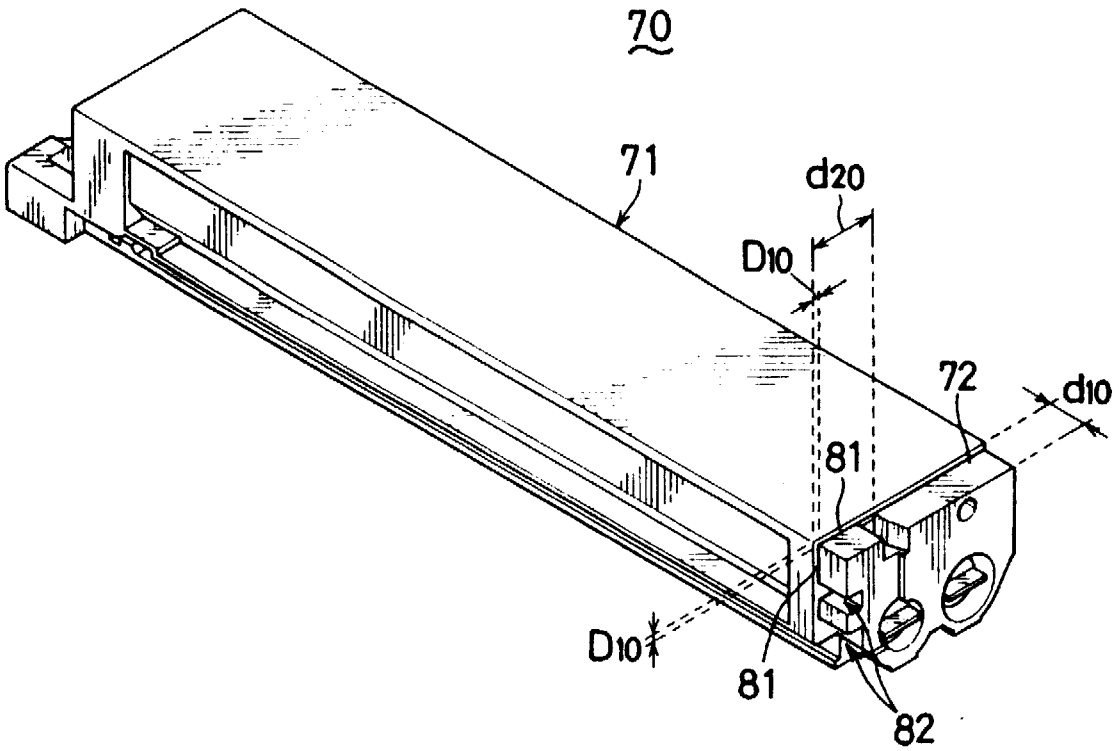
FIG. 10 is a perspective view of the toner container according to the modification (1) when viewed from above.

(1) The protection wall portion 57 of the developing device 50 may extend along the entire length of the upper edge of the side plate portion 53 as shown in FIG. 9. In such a case, the second recesses 81 of the toner container 70 may be formed in a corresponding manner as shown in FIG. 10.

Further, the protection wall portion 57 of the developing device 50 may be formed only along the right edge of the side plate portion 53 of FIG. 3. In such a case, the second recess 81 of the toner container 70 may be formed only at the left edge of FIG. 6.

Figure 11A:
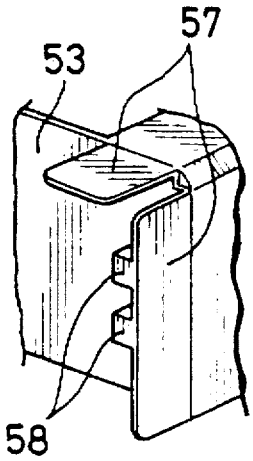
FIGS. 11A and 11B are perspective views of engaging projections formed on a developing device according to a modification (2)
Figure 11B:
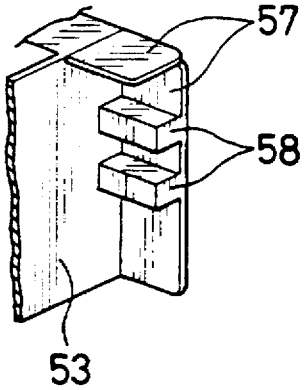

(2) The engaging projection 58 of the developing device 50 may integrally be formed with the protection wall portion 57 as shown in FIGS. 11A and 11B.

Figure 12:
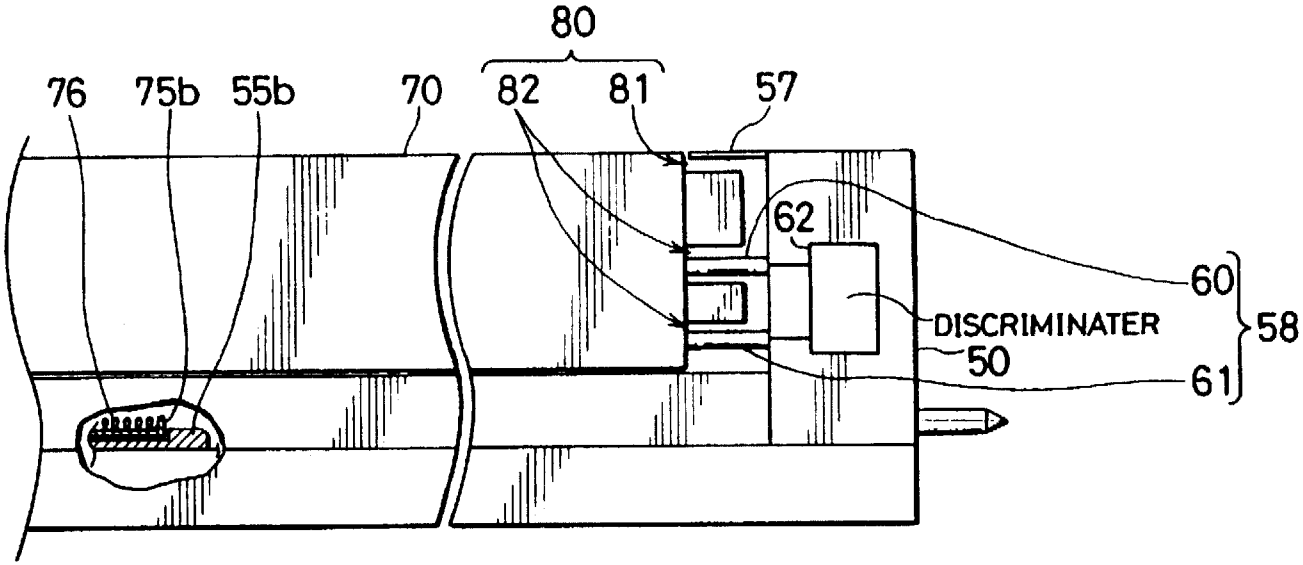
FIG. 12 is a side view showing a state where a toner container according to a modification (3) is set in a developing device.

(3) The construction may be, as shown in FIG. 12, such that metal screws 60, 61 are in contact with one wall surface of each first recess 82 of the toner container 70 while the toner container 70 is set in the developing device 50; the wall surfaces of the first recesses 82 are made of a conductive material; and a discriminator 62 for discriminating whether or not the screws 60, 61 are short-circuited is provided. It should be noted that only the upper part of the protection wall portion 57 of the developing device 50 is shown in FIG. 12 to simplify the description.

According to this modification, the attachment and detachment of the toner container 70 to and from the developing device 50 can automatically be discriminated.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A developing device comprising:

a toner container for supplying toner;

a container receptacle for receiving the toner container therein, the container receptacle includes a positioning plate for positioning the toner container with respect thereto by making contact with a frontal end of the toner container in an insertion direction, engaging means provided on the positioning plate, having a first engaging member, and a second engaging member partially surrounding the contour of the first engaging member when viewed from a rear end of the toner container in the insertion direction.

2. A developing device according to claim 1, wherein the first engaging member includes a plurality of projections provided at a plurality of respective predetermined positions on the positioning plate.

3. A developing device according to claim 1, wherein: the positioning plate has a polygonal shape and stands on the container receptacle, and the second engaging member includes a first protection wall standing along one side of the positioning plate and a second protection wall standing on another side thereof adjacent to the one side so as to meet each other.

4. A developing device according to claim 3, wherein the first protection wall stands along the substantially entire length of a neighboring side adjacent to the bottom side of the positioning plate, and the second protection wall stands along a side adjacent to the neighboring side.

5. A developing device according to claim 4, wherein the projections arranged in a line parallel with the first protection wall.

6. A developing device according to claim 5, wherein the projections are screw bolts and a plurality of threaded holes are formed on the positioning plate such that the number of threaded holes is set greater than the number of screw bolts whereby the screw bolts are selectively insertable through the threaded holes.

7. A developing device according to claim 1, wherein the toner container includes a first engageable portion engageable with the first engaging member and a second engageable portion engageable with the second engaging member.

8. A developing device according to claim 7, wherein the first engaging member is in a form of projection extending from the positioning plate in parallel with the insertion direction of the toner container and the first engageable portion is a first recess formed on the front end of the toner container in the insertion direction and the projection is set to be enclosed in the first recess when the toner container is received in the container receptacle.

9. A developing device according to claim 8, wherein the second engaging member is in a form of plate extending from the positioning plate in parallel with the insertion direction of the toner container and the second engageable portion is a second recess formed on the front end of the toner container in the insertion direction and the second engaging member is set to be received in the second recess when the toner container is received in the container receptacle.

10. A developing device according to claim 9, wherein the second engaging member is in L shape viewed from the rear end of the toner container in the insertion direction thereof.

11. A developing device according to claim 10, wherein the second engaging member is set to form a contour of the container receptacle in the rear end view and an outer surface of the second engaging member is set substantially flush with an outer surface of the corresponding portion of the toner container.

12. A toner container adapted to be set in a container receptacle of a developing device to supply toner to the developing device, the toner container comprises:

an engaging portion formed at a front end thereof with respect to an insertion direction, the engaging portion includes a first engaging member engageable with a projection formed in a specified position of a positioning plate of the container receptacle with which the front end of the toner container with respect to the insertion direction comes into contact, and a second engaging member engageable with a protection wall portion standing in a position of the positioning plate as to enclose the projection.

13. A toner container according to claim 12, wherein the first engaging member is a first recess formed on the leading end of the toner container in an insertion direction and the second engaging member is a second recess formed on the leading end of the toner container in the insertion direction.

14. A toner container according to claim 13, wherein the first recess is continuously formed with the second recess.

15. An electrophotographic image forming apparatus for transferring a toner image obtained by developing an electrostatic latent image formed on the surface of a photosensitive member with toner to a copy sheet, the electrophotographic image forming apparatus comprises:

a developing device includes a toner container for supplying toner and a container receptacle for receiving the toner container therein, the container receptacle having a receptacle engaging portion projecting from a positioning plate for positioning the toner container by being brought into contact with a front end of the toner container to be set with respect to an insertion direction, the receptacle engaging portion having a projection formed in a specified position of the positioning plate and a plate-like protection wall portion standing in a position on the positioning plate as to enclose the projection, and the toner container includes a container engaging portion formed at the front end thereof with respect to the insertion direction, the container engaging portion having a first recess engageable with the projection and a second recess engageable with the protection wall portion.

* * * * *